US006630055B1

(12) United States Patent
Goguelin et al.

(10) Patent No.: US 6,630,055 B1
(45) Date of Patent: Oct. 7, 2003

(54) COATED PAPER INCLUDING A PSEUDO-WATERMARK, AND A METHOD OF MANUFACTURE

(75) Inventors: Michel Goguelin, Besse sur Bray (FR); Nicolas Fourmy, Champagne (FR)

(73) Assignee: Arjo Wiggins Papiers Couches, Issy les Moulineaux (FR)

( * ) Notice: Subject to any disclaimer, the term of this patent is extended or adjusted under 35 U.S.C. 154(b) by 0 days.

(21) Appl. No.: 09/508,625

(22) PCT Filed: Sep. 11, 1998

(86) PCT No.: PCT/FR98/01949

§ 371 (c)(1),
(2), (4) Date: Apr. 24, 2000

(87) PCT Pub. No.: WO99/14433

PCT Pub. Date: Mar. 25, 1999

(30) Foreign Application Priority Data

Sep. 15, 1997 (FR) ..... 97 11441

(51) Int. Cl.[7] ..... D21F 11/00

(52) U.S. Cl. ..... 162/136; 162/110; 162/134; 162/140; 162/135; 428/172; 428/206; 428/211; 427/288; 283/113; 283/72

(58) Field of Search ..... 612/110, 134, 612/140, 135, 136; 428/172, 206, 211; 427/288; 283/113, 72; 127/161; 101/35, 211, 465, 141

(56) References Cited

U.S. PATENT DOCUMENTS 4,824,486 A 4/1989 Lafler

FOREIGN PATENT DOCUMENTS

| | | |
|---|---|---|
| DE | 297 14 004 U1 | 11/1997 |
| EP | 0 027 698 A2 | 4/1981 |
| GB | 456 746 | 11/1936 |
| WO | WO 97/17493 | 5/1997 |

OTHER PUBLICATIONS

"MoDo Makes Its Watermark", Packaging Week 12, No. 39, Apr. 1997, XP002066649, see page 3.

Von Dipl.–Ing. Wolfgang Walenski, "Wasserzeichen und solche, die keine sind", Papier 66.

*Primary Examiner*—Steven P. Griffin
*Assistant Examiner*—M. Halpern
(74) *Attorney, Agent, or Firm*—Oliff & Berridge, PLC

(57) ABSTRACT

The present invention relates to a method of manufacturing a coated paper having at least one mark resembling a watermark, the method being characterized in that said mark is made after the drying step which follows the last coating operation, by performing steps in which: a) a re-wetting solution is applied to at least one face of the coated paper, in one or more determined zones; and b) pressure and heat are applied in said re-wetted zone(s) of the coated paper so as to evaporate said solution and densify the coated paper in said zone(s) relative to the remainder of the paper. The present invention also provides a coated paper including at least one mark resembling a watermark, characterized in that one or more determined zones of the coated paper present a reduction in thickness relative to the remainder of the coated paper, the density per unit area in said zone(s) of the coated paper being identical to that in the remainder of the paper.

39 Claims, 2 Drawing Sheets

ARJO-WIGGINS R&D Bessé -sur- Braye
FIG.3
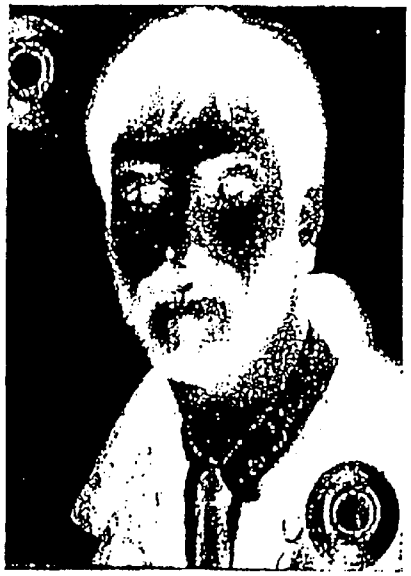
FIG.4 b
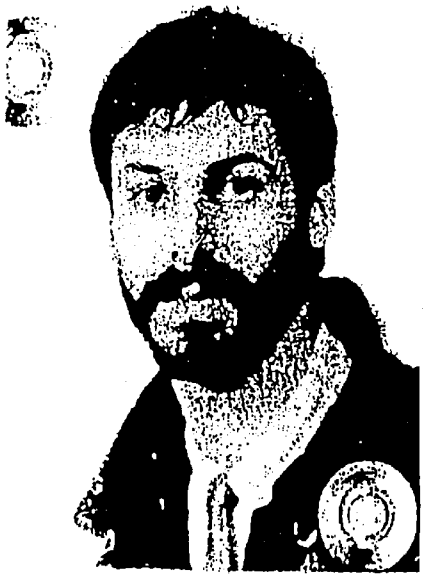
FIG.4 a

COATED PAPER INCLUDING A PSEUDO-WATERMARK, AND A METHOD OF MANUFACTURE

The present invention relates to coated paper having at least one pseudo-watermark constituted by a mark that gives said paper a visual effect and a texture that resemble those of a watermark.

The present invention also relates to a method of manufacturing coated paper of the invention.

BACKGROUND OF THE INVENTION

In general, watermarked paper is used in the field of anti-falsification paper, e.g. for paper money and checks, and for official documents such as passports, stamped papers, notarized deeds, since the presence of the watermark makes infringement and reproduction by photocopying more difficult, and provides means for recognizing and/or authenticating said paper. Watermarked paper is also used in the field of personalized business paper with the logo, name, or trademark of the business being reproduced in the form of a watermark.

For paper that is intended mainly for printing and/or writing, in particular for personalized business paper, coated paper is preferred since print quality is better. However, in these two fields of watermark applications, the tonnage of paper involved is variable and small compared with the production capacity of a modern coating machine.

Various ways are known for making watermarked paper, depending on whether the watermark is a "real" or a "pseudo" watermark.

At present, various methods have been proposed for making watermarked coated paper and they can be classified in three categories.

1) "Real" watermarks are obtained during fabrication of the sheet of paper in the wet portion of the paper-making machine, by means of round shapes that include imprints or embossing in recessed and/or relief form, or by using watermarking rolls having embossing in relief and/or recessed form associated with a flat plate (Fourdrinier machine). A pattern is then obtained that comprises zones that are pale when the sheet of paper is observed in transmitted light, if the imprints are in relief, or zones that are dark or shaded, if the imprints are formed by recesses. The pale zones are due to the fact that the thickness of the sheet and the quantity of fibers (density per unit area) are smaller in the zones corresponding to the imprints than in the remainder of the sheet of paper. Conversely, the dark zones are due to the fact that the thickness of the sheet and the quantity of fibers are greater in the zones corresponding to the imprints.

To make paper that is both watermarked and coated, those wet methods of watermarking are unsuitable for various reasons. Firstly, when the watermark is made in the supporting paper or medium, the difference in thickness and the difference in opaqueness of the sheet in the watermarked zone made on the medium are degraded or even lost when depositing the coating which makes the surface of the medium uniform and opaque. In addition, wet methods of watermarking require the use of expensive implementation means, such as watermarking rolls, that are specific to each type of watermark. Furthermore, since modern coating machines have very great production capacity, they do not provide the flexibility required for manufacturing watermarked coated paper in the small quantities desired by the market.

2) "Pseudo-watermarks" can be made by means of a compound which is caused to penetrate in or to be printed on determined zones of the paper and which acts by making the mat of fibers constituting the sheet of paper more transparent on a permanent basis, or by glazing the surface. Those methods significantly alter the surface properties of paper treated in that way, and in particular the quality of the coating when said paper supports coating, and suitability for printing when said paper is watermarked coated paper.

3) WO 97/17493 describes coated paper with pseudo-watermarks that result from varying the weight of coating applied in determined zones, thereby giving rise to variation in thickness and opaqueness in said zones where the weight of the coating has been reduced or increased. That method requires coating to be made by means of apparatus including a roll, in particular a backing roll, having imprints formed thereon in relief or as recesses for the purpose of causing the quantity of coating to be greater or smaller in the zone of the imprint.

Independently of any difficulties that may be associated with performance thereof, that method requires the conventional coating method to be modified by using special rolls that are specific to each watermark. That method therefore does not provide the flexibility needed to enable small quantities of paper to be manufactured "to order" under conditions that are economically satisfactory when using modern industrial coating machines that have large production capacity.

OBJECTS AND SUMMARY OF THE INVENTION

An object of the present invention is to provide coated paper including pseudo-watermarks constituting marks which modify physical characteristics of the paper in localized manner, e.g. its density, and starting from certain properties such as its thickness and possibly its opaqueness.

Another object of the present invention is to provide coated paper having pseudo-watermarks constituting marks which create gloss and/or shade contrast with the remainder of the sheet of coated paper.

Another object of the present invention is to provide a coated paper having pseudo-watermarks made without requiring ink or glazing to be applied to its surface so that the composition of the paper in the zones constituting the pseudo-watermark is not significantly altered.

Another object of the present invention is to provide coated paper with pseudo-watermarks whose properties in use, in particular properties concerning printability in those zones of the surface of the paper which correspond to said marks, are not significantly spoilt relative to unwatermarked coated paper.

Another object of the present invention is to provide coated paper having pseudo-watermarks that can be manufactured in variable and small quantities under conditions that are more economical than is possible using the methods of the prior art, and that can be obtained in machine widths and quantities that are independent of the characteristics of the coating machine, in particular by means of a method enabling modern coating machines to be used that have large production capacity, and without requiring any modification to be made to the operation of the coating machine proper.

Another object of the present invention is to provide a coated paper having a pseudo-watermark in which said watermark is made after the last coating operation, i.e. at the outlet from the coating machine, and possibly on coated paper that has been finished, i.e. remote from the coating production line.

To do this, the present invention provides a method of manufacturing a coated paper having at least one mark resembling a watermark, the method being characterized in that said mark is made after the drying step which follows the last coating operation, and by performing steps in which:

a) a re-wetting solution is applied to at least one face of the coated paper, in one or more determined zones; and b) pressure and heat are applied in said re-wetted zone(s) of the coated paper so as to evaporate said solution and densify the coated paper in said zone(s) relative to the remainder of the coated paper.

In the present invention, the term "re-wetted coated paper" is used to mean that, in said zone(s), the re-wetting solution has penetrated into the coating and possibly also into the supporting medium, and has not yet evaporated.

In the present invention, said re-wetting solution is evaporated by exerting pressure over the entire sheet of coated paper or only in said zones, and by increasing the temperature of the coated paper, and the coated paper is densified in the zones where said solution was initially applied. This increases the density of the coated paper in said zones relative to the remainder of the sheet of paper, and more precisely this reduces the thickness of the paper while maintaining density per unit area that is identical to the remainder of the paper. Said zones can then present contrast in terms of opaqueness (reduction of opaqueness) and/or contrast in terms of gloss (increase of gloss), and/or contrast in terms of color, and in particular color shade (color difference) relative to the remainder of the sheet of paper.

The opaqueness of the paper is associated in part with the presence of air in the gaps between the fibers of the medium or between the grains of pigment in the coating. During the re-wetting step, the solution replaces the air in said gaps. Then during step b), the solution is evaporated and the fibers and/or the pigment layer are densified, such that the air gaps then occupy smaller overall volume, and in particular the total quantity thereof is smaller than the initial quantity, thereby giving rise to deopacification.

It should be observed, that in original manner, in the method of the invention, densification of the coating and possibly also of the medium comes from a reduction in the thickness of the treated zones relative to the remainder of the coated paper, with the density per unit area and specifically the weight of the layer remaining constant relative to the remainder of the paper. In contrast, in a "real" watermark, the density per unit area is reduced in the pale zones because the quantity of fibers deposited is smaller than in the remainder of the sheet. In the pseudo-watermark described in WO 97/17493, the density per unit area is not constant since the weight of the coating is reduced in certain zones.

The opaqueness contrast can be the result of deopacification of the coating on its own, if the re-wetting solution does not penetrate into the medium, and also from deopacification of the fiber medium if the quantity and the nature of the re-wetting solution and/or the composition of the surface coating enable said solution to penetrate into the medium.

Re-wetting of the surface layer facilitates rearrangement of the pigments during calendering, which can give rise to an increase in gloss depending on the quantity and the nature of the re-wetting solution and depending on the characteristics of the coating. In particular, depending on the size and the shape of the grains of pigment, these are rearranged to a greater or lesser extent during calendering in step b), and the gloss contrast is visible to a greater or lesser extent. Additives can be included in the re-wetting solution and/or in the composition of the coating to facilitate rearrangement of the grains of pigment and/or to facilitate greater or lesser penetration of said solution into the paper.

In practice, to ensure that opaqueness contrast is clearly visible by viewing with transmitted light, it is preferable during the re-wetting operation for the re-wetting solution to penetrate down to the fiber medium.

When the fiber medium is not re-wetted or is re-wetted to a small extent only, and when opaqueness contrast is associated only with a reduction in the opaqueness of the coating, there does indeed exist theoretical reduction in the opaqueness of the coated paper in said zones, but in practice it is difficult for the untrained eye to observe.

Similarly, when the determined re-wetting zones define narrow areas such as the fine lines defining characters or letters, the glossiness contrast when observing with reflected light is difficult for the untrained eye to see.

Similarly, when the surface coating is a matte coating having pigment grains of size and shape such that they cannot be rearranged even by calendering, no gloss contrast can be observed in said zones.

The method of the present invention can also modify the color of the coated paper in said zone(s) when said re-wetting solution includes a coloring agent, and in particular a shading coloring agent. Color contrast in said zone(s) can also result from a modification in the opaqueness of the surface layer when there initially exists a difference in shade between the medium and the surface coating and/or between a first surface coating and a second surface coating, since the shade of the finished coated paper is, in fact, the result of the shades of the medium and of the various coatings applied on the medium. When the medium and the coating have the same shade, shade contrast in said zone(s) can result only from adding a shading coloring additive in the wetting solution. In an advantageous embodiment, the medium is not as bright as the coating.

The method of the present invention applies to all white or colored papers without restriction on weight, and optionally pasted.

Coating compositions for printing and/or writing are well known to the person skilled in the art. The purpose of the coating is to transform the surface of the paper into a uniform microporous surface mainly for the purpose of achieving better printability, and possibly also of improving the whiteness of the paper or the card, its matte, mill-finished, or glossy appearance, or indeed its feel. In addition to printability, the fineness and the shape of the grains of pigment in the coating determine the opaqueness of the coated paper and also its gloss.

In the present invention, the term "coated paper" is used to designate paper that is coated in a pigmented layer having at least fine natural or synthetic inorganic pigments, in particular kaolin and/or calcium carbonate, and at least one binder or adhesive, in particular starch or latex, and also, possibly, any additive commonly employed by the person skilled in the art for the purpose of improving the rheological properties of the coating mixture and of conferring special properties of the coating. The weight of the coating can lie in the range 2 $g/m^2$ to 50 $g/m^2$ on one or both faces, i.e. including paper that is commonly called "surface-treated paper" with coating weights of 2 $g/m^2$ to 10 $g/m^2$. Particular mention is given to coated paper having coating on one or both faces weighing 10 $g/m^2$ to 50 $g/m^2$.

In an implementation, the pigmented layer has 70% to 95% pigment and 5% to 30% binder, ignoring additives.

In the present description, the term "coating operation" is used to designate the operation which consists in depositing a coating composition or a coating mixture comprising fine pigments, a binder or adhesive, water, and additives on one or both faces of a sheet of paper or card which is referred to as the "medium".

The coating of the invention can be applied by any means known to the person skilled in the art on at least one of the two faces, in at least one pass, and in particular using conventional coating installations such as a size press or a metering size press, a metal blade coating machine, an air knife coating machine, or a "champion" type rotary bar coating machine.

The step of drying the coated paper consists in eliminating the water contained in the coating and also the water that has penetrated into the medium. To dry the paper which has just received the coating, it is possible, in particular, to use infrared dryers, conventional drying cylinders optionally surmounted by a high speed hot air blowing hood, or hot air tunnels.

In a preferred implementation, in step b), said pressure and said heat are applied while calendering the coated paper.

The rolls of the calender can be heated, but in any event the friction produced by the calender generates heat.

In the present invention, the calendering operation is performed using calenders known to the person skilled in the art. Calenders are a kind of rolling mill with superposed rolls for the purpose of flattening the surfaces by compressing them in order to make them suitable for writing and printing, and also to give them a feel that is somewhat soft, and somewhat "smooth". On passing between the rolls, the peaks of portions in relief are flattened by the pressure, and the sheet is made denser. Another purpose of calendering can also be to make the surfaces glossy. In addition to the pressure effect, slip is encouraged between the sheet and the rolls so as to fill in recesses in part and so as to orient the fibers and the fillers situated at the surface so that they lie in the plane thereof.

The calender is generally constituted by quenched cast iron rolls alternating with resilient rolls. Microsliding takes place between the various rolls with the effect of giving a milled and glossy appearance thereto. The calender is often situated outside the machine for reasons associated with maintenance, roll changing, and sheet breaks. The linear pressure exerted on the paper between the rolls is of the order of 0.5 kN/cm to 500 kN/cm. When heated, the temperature of the rolls can lie in the range 50° C. to 3000° C.

In the present invention, and for given equipment, the various calendering parameters such as temperature, press hardness, and pressure are selected as a function of the desired final contrast. These various parameters are adapted as a function of calendering speed, itself controlled by the rate at which the re-wetting solution is applied. The calendering operation does not give rise to additional costs insofar as all high-quality coated papers, even when matte, are, in practice, calendered.

In the present invention, the mark can correspond to said zone(s) and can constitute a given pattern that appears positive in contrast relative to the remainder of the non-re-wetted sheet of paper. Conversely, the given pattern can appear negative in contrast insofar as the mark corresponds to the non-treated remainder of the sheet of paper, i.e. that part which was not initially re-wetted. In particular, said zone(s) can define a visible pattern when observed in transmitted light that results from a reduction of opaqueness in said zone(s). Said zone(s) can also define a visible pattern when observed in reflected light that results from an increase in gloss and/or a color difference of said zone(s).

Said mark preferably corresponds to said treated zone(s).

Preferably, in order to satisfy the volume objectives for made-to-measure markets, step a) is performed on coated paper remote from the coating line, i.e. it is performed on finished coating paper.

In step a) the re-wetting solution of the invention can be applied by means of a heliograph having a photoetching cylinder whose imprints or recesses are shaped so as to enable said re-wetting solution to be applied in a pattern corresponding to said mark in said zone(s).

The re-wetting solution is preferably applied by means of a device of the type used in ink jet printing methods, and in particular methods of ink jet printing on reels, it being understood that said ink is replaced by said re-wetting aqueous solution. Ink jet printing devices, and in particular digital ink jet printer devices enable marks to be made in various patterns that can be modified quickly and at low cost from one run to another.

Said re-wetting solution advantageously includes a wetting agent so as to improve or accelerate penetration of the solution into the coating and possibly also into the medium. Said wetting agent can be advantageous, in particular depending on the characteristics of the coating, specifically its porosity and the optional presence therein of a wetting agent, and also depending on the characteristics of the medium, and finally on the quantity of re-wetting solution that is applied. As an illustration, it is possible to apply re-wetting solution at a rate of 2 $g/m^2$ to 20 $g/m^2$.

Advantageously, said re-wetting solution is a solution of a hydrophilic polar solvent.

As a wetting agent, it is possible in particular to use ethanol or 2-pyrrolidone.

The re-wetting solution is preferably an aqueous solution, since the use of a non-aqueous solvent would give rise to greater costs and run the risk of pollution.

In a suitable embodiment, in particular for re-wetting commercially available coated papers for printing and/or writing, it is possible for the re-wetting solution to be an alcohol-and-water solution.

More particularly, it is possible to use an aqueous solution containing 1% to 10% by volume of ethanol, and in particular 2%, in water, or an aqueous solution containing 1% to 10% by weight of 2-pyrrolidone, in particular 2% in water.

In some cases, it can be possible to use water without a wetting agent as the re-wetting aqueous solution, particularly when the coated paper is very porous and/or includes wetting agents in its own composition, as it the case for certain silica-based coatings used for paper that is specifically designed for ink jet printing.

The re-wetting solution may optionally also include additives such as dyes, in particular shading coloring agents, fluorescent whitening agents (optical bleaches) or conversely agents that inhibit fluorescence and any additive known to the person skilled in the art for enabling anti-falsification paper to be recognized or authenticated. In particular, the re-wetting solution can include an anti-falsification agent or an authentication agent that is colorless and suitable for being revealed by reacting with a determined co-reagent or under special conditions.

The present invention also provides coated paper including at least one mark resembling a watermark and characterized in that one or more determined zones of the coated paper present thickness that is smaller than the thickness of the remainder of the sheet of coated paper, with the density per unit area in said zone(s) of coated paper being identical to that of the remainder of the paper. In particular, the weight of the coating is identical in said zone(s) and in the remainder of the paper, it being understood that the amount of variation in the weight that could result from the presence of a non-evaporated additive from the re-wetting solution is not significant.

In an embodiment, said zone(s) present(s) reduced opaqueness relative to the remainder of the coated paper.

In another variant embodiment, said zone(s) can present greater gloss than the remainder of the coated paper.

In another variant embodiment, said zone(s) can present a color, and in particular a shade, that differs from that of the remainder of the coated paper.

In paper of the present invention, the medium and the layer(s) of coating thereon can present reduced thickness and opaqueness in said zone(s) relative to the remainder of the coated paper.

In a variant, only the surface coating(s) on the medium need present a reduction in thickness and an increase in gloss in said zone(s) relative to the remainder of the coated paper, the thickness of the medium remaining unchanged.

Finally, in the present invention, the coating can present on its surface in said zone(s) agents selected from coloring agents, fluorescent agents, fluorescence-inhibiting agents, and agents for recognition or authentication purposes. These agents can be deposited by applying the re-wetting solution and can remain after it has evaporated. Anti-falsification or authentication agents are well known to the person skilled in the art in the field of anti-falsification paper.

BRIEF DESCRIPTION OF THE DRAWINGS

Other characteristics and advantages of the present invention appear in the light of the following detailed description of various embodiments.

FIG. 3 shows the pattern constituted by the name of the Applicant in application of Example 3.

FIGS. 4*a* and 4*b* show the pseudo-watermark of FIG. 7. In all of the figures, the dark zones (1) represent zones that were initially re-wetted. On the real paper, when observed by transmitted light, they actually appear paler when contrast is by opaqueness, or glossier and/or darker when contrast is by gloss and/or shade. The zones (2) are non-treated zones.

MORE DETAILED DESCRIPTION

CONDITIONS A

To simulate digital print systems by means of an ink jet on a reel, a Hewlett Packard Deskjet 500 C office printer was used fitted with a cartridge referenced 51626A that had previously been emptied of its ink, cleaned, and then filled with a re-wetting solution constituted by distilled water together with 2% by volume ethanol, so as to re-wet the following papers with various patterns. In these examples, the marks are positive and the quantity of re-wetting solution supplied for a sheet wetted at a resolution of 300 dots per inch, and the pitch conditions were "coarse grain", at "letter" quality, with "normal" intensity setting, of about 12 g/M$^2$.

Immediately after being re-wetted, the paper was passed through a laboratory calender having two rolls heated to 50° C., and applying linear pressure of 1.9 kN/cm.

EXAMPLE 1

OPAQUENESS CONTRAST

Figure 1:
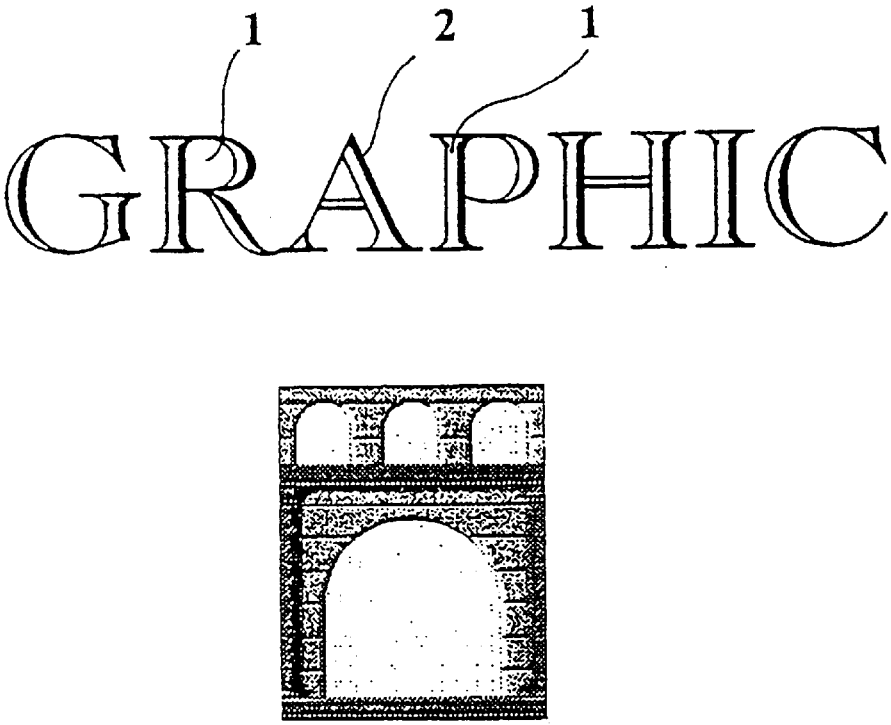
FIG. 1 shows the pseudo-watermark of Example 1.

A sample of 135 g/m$^2$ of white paper taken raw from a non-calendered coating machine and corresponding after finishing to three-layer two-face coated paper with a total coating weight of 45 g/m$^2$, sold under the trademark Maine®, gave rise after being re-wetted with the pattern of FIG. 1 which constitutes the image of a gate and the word "GRAPHIC", using software implementing Times New Roman 72 font, followed by calendering, to a coated paper having marks resembling a translucent shaded watermark of the image of the gate and the pattern "GRAPHIC". Given the fineness of the lines constituting the letter characters, the gloss effect was difficult to observe. The variable reduction in thickness in the treated zone went up to as much as 40% compared with the remainder of the paper.

EXAMPLE 2

GLOSS AND COLOR CONTRAST

Figure 2:
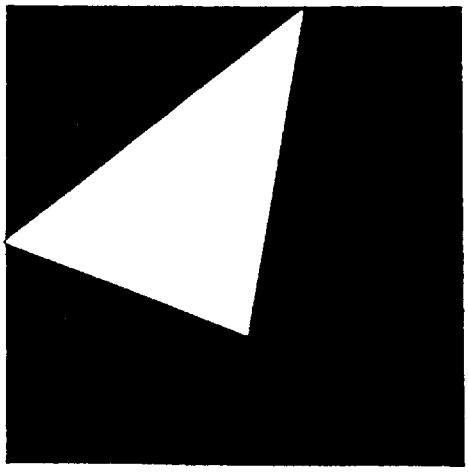
FIG. 2 shows the logo of the Applicant in application of Example 2.

A sample of 250 g/m$^2$ ivory color paper, taken raw from the non-calendering coating machine, and corresponding after finishing to three-layer, two-face coated paper with a total coating weight of 68 g/m$^2$, sold under the trademark Ideal®, gave rise, after re-wetting with the image of the Applicant's logo, followed by calendering, to coated paper presenting the Applicant's logo as shown in FIG. 2 as a "watermark" by contrast with a gloss difference of +6 points (TAPPI 75°) and with a color difference $\Delta E$ of 1.19 (CIELAB 1976). Given the considerable thickness and weight of the medium and the quantity of re-wetting solution applied, the solution did not penetrate in satisfactory manner into the fiber medium so that the loss of opaqueness was very small and no significant opaqueness contrast was observed. The thickness reduction in the treated zones was about 6% relative to the remainder of the paper.

EXAMPLE 3

OPAQUENESS CONTRAST

Under the same conditions as in Example 1, 90 g/m$^2$ surface-treated paper was used that had been watermarked in conventional manner in the wet portion of the paper-making machine, corresponding to the watermarked laid paper sold under the trademark Conqueror®. After the paper had been re-wetted with a pattern constituting by the words "ARJO WIGGINS", and then calendered, paper was obtained having opaqueness contrast, when observed in transmitted light, with the "ARJO WIGGINS" watermark of the invention and the original clear watermarks being juxtaposed without any difference in quality. Gloss contrast was difficult to observe on this Conqueror® surface-treated paper which has a coating with little pigment.

EXAMPLE 4

OPAQUENESS AND FLUORESCENT CONTRAST

A sample of 135 g/m$^2$ Maine® type white paper of Example 1 as manufactured using a laboratory coating machine with a coating composition that had no whitening fluorescent agent, was processed using the same conditions as in Example 1 with a re-wetting solution constituted by distilled water, 2% by volume ethanol, and 2% by volume of a whitening fluorescent agent sold under the trademark Blancophor® BSU PN. After calendering, the coated paper presented a pattern constituted by the words "ARJO WIGGINS" that was visible in transmitted light by opaqueness contrast and that was revealed to a greater or lesser extent in direct viewing by shading and fluorescent contrast depending on the ultraviolet radiation content of the natural or artificial incident light used for observation.

CONDITIONS B

An Epson Stylus Color 1520 printer was used provided with a cartridge having the reference S 020 108, that had previously been emptied of its ink, cleaned, and then filled with a re-wetting solution, so as to make a positive print of the pattern shown in FIG. 3 with a resolution of 720 dots per inch on two-face coated paper having a total coating weight of 38 g/m$^2$ and sold under the trademark Chromomat® 115 g/m$^2$.

EXAMPLE 5

The re-wetting solution was constituted by distilled water and 2% by weight of 2-pyrrolidone (98% pure).

After calendering at 50° C., with a linear pressure of 1.0 kN/cm, a matte coating was obtained with a pseudo-watermark of the invention, contrasted in shade and in opaqueness.

EXAMPLE 6

The re-wetting solution was constituted by distilled water and 2% by volume ethanol, however in this case the re-wetted coated paper was passed between the 50° C. rolls of an embossing press, and embossed (cambric) coated paper was obtained with a pseudo-watermark of the invention visible by opaqueness contrast.

CONDITIONS C

Yet another printer was used, a Hewlett Packard Deskjet 560 C provided with a cartridge of reference 51626A previously emptied of its ink, cleaned, and then filled with a re-wetting solution constituted by distilled water and 2% by volume ethanol, and the following example was printed as a positive at a resolution of 600×300 dots per inch. Immediately after being re-wetted, the paper was passed through a laboratory calender (different from that used in Conditions A and B) with its two rolls heated to 50° C., and applying linear pressure of 3.0 kN/cm.

EXAMPLE 7

A sample of 115 g/m$^2$ white paper coated on both faces and glossy, i.e. already calendered, with a coating having a total weight of 39 g/m$^2$, and a medium of lower gloss than the coating, received the pattern of FIGS. 4*a* and 4*b* which comprises two reproductions of an identity photograph, with the dark parts of the photograph being re-wetted for FIG. 4*a* and with the pale parts being re-wetted for FIG. 4*b*, so that after calendering and drying, the glossy coated paper obtained in this way was an anti-falsification paper personalized by the two pseudo-watermarks of the identity photograph, which could be seen as follows:

in FIG. 4*a*: by direct viewing in the form of shade contrast (wetted zones having become less glossy); and in FIG. 4*b*: by observation using transmitted light in the form of opaqueness contrast (wetted zones had become less opaque and thus paler); it being understood that conversely FIG. 4*a* in transmitted light and FIG. 4*b* in direct viewing are both perceived as being printed of the negative of the identity photograph.

What is claimed is:

1. A coated paper, comprising at least one zone having a reduction in thickness relative to a remainder of the coated paper, said coated paper having a mass per unit area in said at least one zone identical to that in the remainder of the coated paper so as to form at least one mark resembling a watermark.

2. The coated paper according to claim 1, said coated paper having a coating, wherein a mass per unit area of said coating is identical in said at least one zone and in the remainder of the coated paper.

3. The coated paper according to claim 1, wherein said at least one zone presents a reduction in opaqueness relative to the remainder of the coated paper.

4. The coated paper according to claim 1, wherein said at least one zone presents an increase of gloss relative to the remainder of the coated paper.

5. The coated paper according to claim 1, wherein said at least one zone presents a color that is different from that of the remainder of the coated paper.

6. The coated paper according to claim 1, said coated paper having a medium and a coating, wherein the coating and the medium present a reduction of thickness and of opaqueness in said at least one zone relative to the remainder of the coated paper.

7. The coated paper according to claim 1, said coated paper having a medium and a coating, wherein the coating on the surface of the medium presents a reduction of thickness and an increase of gloss in said at least one zone relative to the remainder of the coated paper.

8. The coated paper according to claim 1, said coated paper having a coating, wherein the coating presents on the surface of said at least one zone, at least one agent selected from the group comprising a coloring agent, fluorescent agent, fluorescence-inhibiting agent, or anti-falsification or authentication agent.

9. The coated paper according to claim 1, wherein the coated paper has a 2 g/m$^2$ to 50 g/m$^2$ pigmented coating.

10. The coated paper according to claim 9, wherein the coating is a 10 g/m$^2$ to 50 g/m$^2$ pigmented coating.

11. The coated paper according to claim 9, wherein the coating is a 2 g/m$^2$ to 10 g/m$^2$ pigmented coating.

12. A coated paper according to claim 1, wherein said at least one zone has a shade that is different from that of the remainder of the coated paper.

13. A coated paper according to claim 1, comprising a coating on only one face of the coated paper.

14. A coated paper according to claim 1, comprising a coating on both faces of the coated paper.

15. A method of manufacturing a coated paper having at least one mark resembling a watermark, wherein said mark is made after the drying step which follows the last coating operation, comprising:

a) applying a re-wetting solution to at least one face of the coated paper, in at least one determined zone forming at least one rewetted zone; and b) applying pressure and heat at least in said at least one re-wetted zone of the coated paper so as to evaporate said solution and densify the coated paper in said at least one zone relative to a remainder of the coated paper.

16. A method according to claim 15, wherein in step a) said re-wetting solution is applied by means of a device for ink jet printing on paper.

17. A method according to claim 16, wherein said device comprises a digital ink jet printer in which the ink is replaced by said re-wetting solution.

18. A method according to claim 15, wherein in step b) said pressure and said heat are applied by calendering the coated paper.

19. A method according to claim 15, wherein step a) is performed on a coated face of said coated paper.

20. A method according to claim 15, wherein said re-wetting solution is an aqueous solution.

21. A method according to claim 15, wherein said re-wetting solution comprises at least one additive selected from the group consisting of wetting agents, coloring agents, whitening fluorescent agents, fluorescence-inhibiting agents, anti-falsification agents and authentication agents.

22. A method according to claim 20, wherein said aqueous solution is an alcohol-and-water solution.

23. A method according to claim 22, wherein said aqueous solution contains 1% to 10% by volume of ethanol in water.

24. A method according to claim 21, wherein said aqueous solution contains 1% to 10% by weight of 2-pyrrolidone in water.

25. A method according to claim 21, wherein the coloring agents comprise shading agents.

26. A method according to claim 15, wherein the color of a surface layer differs from that of at least one of a fibrous medium and one of a pre-layer and under-layer.

27. A method according to claim 15, wherein said at least one zone defines a pattern visible in transmitted light as a result of a reduction in the opaqueness of said at least one zone.

28. A method according to claim 15, wherein said at least one zone defines a pattern visible in reflected light as a result of the increase in the glossiness in said at least one zone.

29. A method according to claim 15, said coated paper having a surface, wherein the pressure and the heat are applied over the entire surface of the coated paper.

30. A coated paper obtained by implementing the method as defined in claim 15.

31. A method according to claim 15, wherein said at least one zone defines a pattern visible in reflected light as a result of the increase in a color difference in said at least one zone.

32. A coated paper, comprising:

a first zone, having a first thickness and a mass per unit area, and a second zone configured to form with the first zone a mark visible in at least one of reflected light and transmitted light, said second zone being different from the first zone and having a second thickness less than a first thickness of the first zone and the same mass per unit area as the first zone.

33. A method of forming at least one mark on a coated paper, comprising:

a) re-wetting the coated paper in one zone, and b) densifying the coated paper in said zone to form said mark.

34. A method according to claim 33, wherein said densifying comprises applying pressure and heat over a surface of said coated paper.

35. A method according to claim 34, wherein said surface extends entirely over said coated paper.

36. A method according to claim 33, wherein said re-wetting comprises applying on the coated paper a solution consisting of at least one additive selected from the group consisting of wetting agents, coloring agents, whitening fluorescent agents, fluorescence-inhibiting agents, anti-falsification agents and authentication agents.

37. A method according to claim 36, wherein the coloring agents comprise shading agents.

38. A method according to claim 33, wherein the re-wetting comprises applying a wetting solution on the coated paper with a pattern corresponding to said at least one mark.

39. A method according to claim 38, wherein the re-wetting solution is applied using an ink jet printer.

* * * * *